US010532273B2

(12) United States Patent
Martineck, Sr.

(10) Patent No.: US 10,532,273 B2
(45) Date of Patent: Jan. 14, 2020

(54) SCRATCH-OFF LOTTERY TICKET GAME STRUCTURE AND METHOD WITH DYNAMIC VALIDATION FILES TO SUPPORT VARIABLE PRIZE STRUCTURES

(71) Applicant: Scientific Games International, Inc., Newark, DE (US)

(72) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 12 days.

(21) Appl. No.: 15/915,261

(22) Filed: Mar. 8, 2018

(65) Prior Publication Data

US 2019/0275414 A1 Sep. 12, 2019

(51) Int. Cl.
*G07F 17/32* (2006.01)
*A63F 3/06* (2006.01)

(52) U.S. Cl.
CPC ..... *A63F 3/0665* (2013.01); *G07F 17/329* (2013.01); *G07F 17/3262* (2013.01); *G07F 17/3218* (2013.01)

(58) Field of Classification Search
None
See application file for complete search history.

(56) References Cited

U.S. PATENT DOCUMENTS 7,151,206 B2 12/2006 Bertnett, III
7,416,484 B1 8/2008 Nelson et al.
8,512,123 B2 * 8/2013 Stanek ..... G07F 17/32 463/17
8,628,082 B2 * 1/2014 Martineck ..... A63F 3/0665 273/138.1
10,130,869 B2 * 11/2018 Finnerty ..... A63F 3/0665
10,249,144 B2 * 4/2019 Irwin, Jr. ..... G07F 17/329
2003/0181235 A1 * 9/2003 Bennett, III ..... G06Q 20/3437 463/17

(Continued)

FOREIGN PATENT DOCUMENTS

WO WO 2013/013299 A1 1/2013

OTHER PUBLICATIONS

EP Search Report, dated May 27, 2019.

*Primary Examiner* — Ronald Laneau
(74) *Attorney, Agent, or Firm* — Dority & Manning, P.A.

(57) ABSTRACT

An instant lottery ticket game structure and method includes a set of instant lottery tickets, wherein a plurality of these tickets are winning tickets having a predetermined first prize value, as well as a predetermined enhanced second prize value. A first validation file is maintained in a central host computer having a primary record for each winning ticket, the primary record including ticket identification data and the predetermined first prize value. A second validation file maintained by a computer includes a base record for each winning ticket having the prize enhancement code for the winning ticket and the second prize value assigned to the winning ticket. A logic gate in the base record automatically activates upon entry of the prize enhancement code, wherein the computer creates a final record for the winning ticket by modifying the base record to include the second prize value as a final prize value. The first validation file is periodically updated with the final records.

16 Claims, 4 Drawing Sheets

(56) References Cited

U.S. PATENT DOCUMENTS

| | | | | |
|---|---|---|---|---|
| 2008/0132311 | A1 | 6/2008 | Walker | |
| 2010/0062825 | A1* | 3/2010 | Frick | A63F 3/081 463/17 |
| 2012/0202572 | A1 | 8/2012 | Stanek et al. | |
| 2012/0299241 | A1* | 11/2012 | Frick | A63F 3/081 273/139 |
| 2014/0187305 | A1 | 7/2014 | Irwin, Jr. | |
| 2017/0345252 | A1 | 11/2017 | Martineck, Sr. | |

* cited by examiner

SCRATCH-OFF LOTTERY TICKET GAME STRUCTURE AND METHOD WITH DYNAMIC VALIDATION FILES TO SUPPORT VARIABLE PRIZE STRUCTURES

BACKGROUND

The lottery or gaming industry is continuously seeking methods to enhance the gaming experience for players, as well as to increase the benefit for participating retail establishments that sell lottery tickets.

Scratch-off ("instant") lottery tickets are a mainstay of the lottery industry and are quite popular among players. However, the conventional paper-based and simulated electronic scratch-off tickets have been in use for quite some time and the industry is continuously seeking ways to enhance the tickets and game playing experience so as to continue to attract new players. Such enhancements are, however, limited by the essentially "static" nature of the prize structures associated with such tickets dictated by the security requirements of the associated ticket validation files.

In conventional scratch-off lottery ticket systems, especially those in the United States that are administered by state governments, each winning ticket (or all tickets) is printed with a validation number or code that identifies and links the ticket to a validation file stored in a central host computer maintained by the game administrator, the validation file containing the redemption value of the ticket. Winning tickets are presented by players to lottery agents for redemption, wherein the agent enters ticket identification or validation data from the ticket into an agent terminal using a bar code reader or manually inputting this data. This information is then transmitted to the host computer and is used to access the validation file. Typically, there is one record in the validation file for each such winning ticket that contains the redemption value of the ticket. The redemption value is transmitted to the lottery terminal and if the transmitted value matches the printed winning value on the lottery ticket, the agent will pay the prize amount to the player.

Similarly, in certain electronic lottery systems, winning eTicket vouchers are presented by players to lottery agents or lottery validation systems for redemption. In many cases, in particular where the eTicket has a high value, the lottery agent or system will transfer eTicket identification or validation data from the eTicket into an agent terminal via a bar code or by manually inputting this data. This information is then transmitted to the host computer at the state lottery administration where and used to access the validation file, in particular the record in the validation file for such winning eTicket that contains the redemption value of the ticket. This redemption value is then transmitted to the agent terminal and if the transmitted redemption value matches the printed winning value on the voucher, the agent will pay the prize amount to the player.

With such conventional systems, the validation file contains a fixed or static prize value for all tickets that contain a winning prize value. However, while maintaining a static prize value for each ticket in the validation file has been considered desirable from a security standpoint, maintaining the static value reduces the flexibility of lottery administrations to create new types of games and to compensate for various problems such as the problem described above.

U.S. Pat. No. 7,153,206 proposes a system and method wherein provision is made for the instant lottery tickets to have variable redemption values by allowing the prize codes in the validation file to be changed under certain predetermined circumstances. At least some of the lottery tickets in the game, whether printed or electronically simulated, are provided with play indicia under a scratch-off coating that indicates that the redemption value of that lottery ticket is variable under certain predetermined criteria. Using the host computer, personnel at the lottery administration can change the prize codes and therefore the redemption value of these instant lottery tickets according to the predetermined criteria (such as the termination of a game). A player can have the option to redeem an instant lottery ticket for a first value or wait until after termination of the game where a possibly higher redemption value might be assigned to that ticket due to the host computer randomly selecting that ticket to change its prize code to a greater value.

Although the '206 patent suggests a means to provide a variable prize structure to instant lottery ticket game structures, the proposed solution relies on eventual human intervention and modification of the validation file. This aspect is undesirable from a security aspect.

The present invention seeks methods and game structures that allow a variable prize structure for instant lottery ticket games yet preserves security of the validation file structure.

SUMMARY

Objects and advantages of the invention will be set forth in part in the following description, or may be obvious from the description, or may be learned through practice of the invention.

In a particular embodiment, an instant lottery ticket game structure is provided that comprises a set of instant lottery tickets (i.e., scratch-off lottery tickets). A plurality of the instant lottery tickets in the set are winning tickets that have a positive (greater than zero) predetermined first prize value. Game play indicia is provided on the ticket and is covered by a scratch-off coating. A player removes the scratch-off coating from the game play indicia to reveal the winning status of the ticket and the first prize value.

The instant lottery tickets may be printed paper tickets, or may be electronically simulated tickets that are transmitted to and played by the player via an application running on a smart device, such as a mobile phone, tablet, computer, etc.

The winning tickets have a prize enhancement code provided thereon that enables the player with the option to trade the first prize value for a potential enhanced prize having a value that is greater than the first prize value. For example, the enhanced prize may be a multiple (e.g. 2× or 3×) of the first prize value. This option, however, comes at a risk to the player that the enhanced prize is actually a loss of all or part of the first prize value. In this regard, each winning ticket has a predetermined second prize value assigned thereto that corresponds to the enhanced prize and may be greater than or less than the first prize value. For example, the second prize value may be an increase (e.g., a multiple) of the first prize value, less than the first prize value, or a total loss of the first prize value.

A first electronic validation file is created and maintained in a central host computer and includes a primary record for at least each of the winning tickets, the primary record including ticket identification data and the predetermined first prize value assigned to the winning ticket.

A second validation file is created and maintained by a computer, the second validation file including a base record for at least each of the winning tickets that essentially corresponds to the primary record in the first validation file for the winning ticket, and the prize enhancement code for the winning ticket. The second validation file also includes the second prize value assigned to the winning ticket either in the base record or separate from the base record.

If the player does not opt for the enhanced prize possibility, then the primary record in the first validation file will not be modified and remains as the final validation file record for that particular ticket. However, if the player does take the option, a logic gate in the base record in the second validation file is activated and the computer automatically modifies the base record to include/substitute the second prize value as the actual prize for the winning ticket upon entry of the prize enhancement code by or for the player. This may be accomplished by various means. For example, the second prize value may be contained in the base record along with the first prize value, wherein the first prize value is essentially deleted from the base record upon entry of the prize enhancement code. Alternatively, the second prize value may be contained in a separate record (i.e., a sub-record) and imported into the base record to overwrite the first prize value upon entry of the prize enhancement code. The modified base record becomes a final record for the winning ticket in the second validation file. The central host computer is configured to periodically update the first validation file with the final records generated in the second validation file.

With the above game structure and method, the first validation file is "dynamic" is that it the individual ticket records contained therein are automatically changed or updated to reflect the changing prize value of any of the instant lottery tickets in the set. For redemption, accounting, confirmation, and any other post-sale reason, the first validation file in the central host computer accurately reflects the final value of the tickets in the set. This is accomplished without the need of personnel intervention or access to the first validation file.

In a particular embodiment, the computer that maintains the second validation file is also the central host computer. Alternatively, the computer may separate and remote from the central host computer, wherein the final records generated for the second validation file are periodically transmitted to the central host computer. In this embodiment, the prize enhancement code would be transmitted to the computer directly or via the central host computer to activate the logic gate.

In a certain embodiment, the first validation file may include a primary record for each of the instant lottery tickets in the set of instant lottery tickets (including the losing tickets), and the second validation file may also include a base record for each of the instant lottery tickets in the set of instant lottery tickets (including the losing tickets). Likewise, each of the instant lottery tickets in the set of instant lottery tickets (including the losing tickets) may include a prize enhancement code provided thereon, wherein the prize enhancement code is only active for the winning tickets.

In a particular embodiment of the instant lottery ticket game structure, at a defined section of the ticket, the prize enhancement code is covered by a scratch-off coating on the instant lottery tickets, wherein the player removes the scratch-off coating and presents the prize enhancement code to the central host computer (e.g. via a lottery agent for transmission to the host computer, or by transmission via the player's smart device for electronic ticket embodiments). In a certain embodiment, the losing lottery tickets in the set may also include a simulated prize enhancement code in the form of a scratch-off coating over a generic indication that the ticket is a losing ticket in the defined section of the ticket so that winning and losing tickets are indistinguishable to the player prior to purchase and play of the ticket.

The game structure may include a unique means of revealing the outcome of the enhanced prize option to the player. For example, the game structure may include a computer application enabled on a smart device operated by the player (e.g. a smart phone, tablet, PDA, computer, etc.), wherein results of entry of the prize enhancement code are revealed to the player via the smart device upon entry of a code by the player. This code may be provided on the winning ticket, for example along with the prize enhancement code under the scratch-off coating, or may be the prize enhancement code. Alternatively, the code may be generated and given to the player when the prize enhancement code is entered by the lottery agent at a terminal. For example, the terminal may print off a receipt having the code thereon, wherein the receipt is then handed to the player.

The present invention also encompasses various method embodiments for implementing an instant lottery ticket game in accordance with certain aspects discussed above. For example, a particular embodiment includes providing a set of instant lottery tickets, including designating a plurality of the instant lottery tickets as winning tickets that have a positive predetermined first prize value assigned thereto that is revealed to a player by removal of a scratch-off coating from over prize indicia provided on the winning tickets.

The method includes configuring at least the winning tickets with a prize enhancement code that provides the player with the option to trade the first prize value for an enhanced prize having a potential value that is greater than the first prize value. The winning tickets are each assigned a predetermined second prize value that may be greater than or less than the first prize value, the second prize value corresponding to the enhanced prize.

Prior to distribution of the instant lottery tickets for sale, the method includes creating a first validation file and maintaining the first validation file in a central host computer, the first validation file including a primary record for at least each of the winning tickets, the primary record including ticket identification data and the predetermined first prize value for the winning ticket.

At the time of creating the first validation file, the method includes creating and maintaining a second validation file in a computer, the second validation file including a base record for at least each of the winning tickets, the base record including the ticket identification information from the primary record in the first validation file and the prize enhancement code for the winning ticket. The second validation file further includes the second prize value assigned to the winning ticket.

The method includes configuring the base record with a logic gate that automatically activates upon entry of the prize enhancement code, wherein the computer then creates a final record for the winning ticket by modifying the base record to include the second prize value as a final prize value for the winning ticket. The central host computer is configured to periodically update the first validation file with the final records generated in the second validation file.

The method may include configuring the central host computer to also function as the computer that maintains the second validation file. Alternately, the computer that maintains the second validation file is separate and remote from the central host computer, and the method includes periodically transmitting the final records generated by the second validation file to the central host computer.

The method may include generating a primary record in the first validation file includes for each of the instant lottery tickets in the set of instant lottery tickets (including the losing tickets). Likewise, the second validation file may include a base record for each of the instant lottery tickets in the set of instant lottery tickets. In this regard, each of the instant lottery tickets in the set of instant lottery tickets (including the losing tickets) may include a prize enhancement code provided thereon, wherein the prize enhancement code is only active for the winning tickets, so that all tickets in the set have the same initial appearance to the players.

As discussed above, the method may include a unique means of revealing the outcome of the enhanced prize option to the player. For example, the game structure may include a computer application enabled on a smart device operated by the player (e.g. a smart phone, tablet, PDA, computer, etc.), wherein results of entry of the prize enhancement code are revealed to the player via the smart device upon entry of a code by the player. This code may be provided on the winning ticket, for example along with the prize enhancement code under the scratch-off coating, or may be the prize enhancement code. Alternatively, the code may be generated and given to the player when the prize enhancement code is entered by the lottery agent at a terminal. For example, the terminal may print off a receipt having the code thereon, wherein the receipt is then handed to the player.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Generally, the present disclosure is directed to a computer-based instant lottery ticket game structure and associated method (indicated generally as "60" in FIG. 4) of operation that utilize a dynamic validation file configuration to provide increased flexibility to game features and prize structures without comprising security of the validation file.

It is typical practice in the United States lottery industry for a ticket manufacturer/vendor (who may also be the game service provider for the lottery authority) to provide a state lottery authority with one or more sets of instant lottery tickets, where each set is defined as a game. Each game will normally have a prize structure with a predetermined number of winning tickets and a predetermined number of losing tickets structured to achieve the expected value of the game. Very often, the winning tickets are divided between high tier winners, which have a high winning prize value (and lesser odds of winning) and low tier winners that have relatively low winning values (and greater odds of winning). This initial prize structure is referenced herein as a "first prize value" with respect to the individual tickets.

Figure 1A:
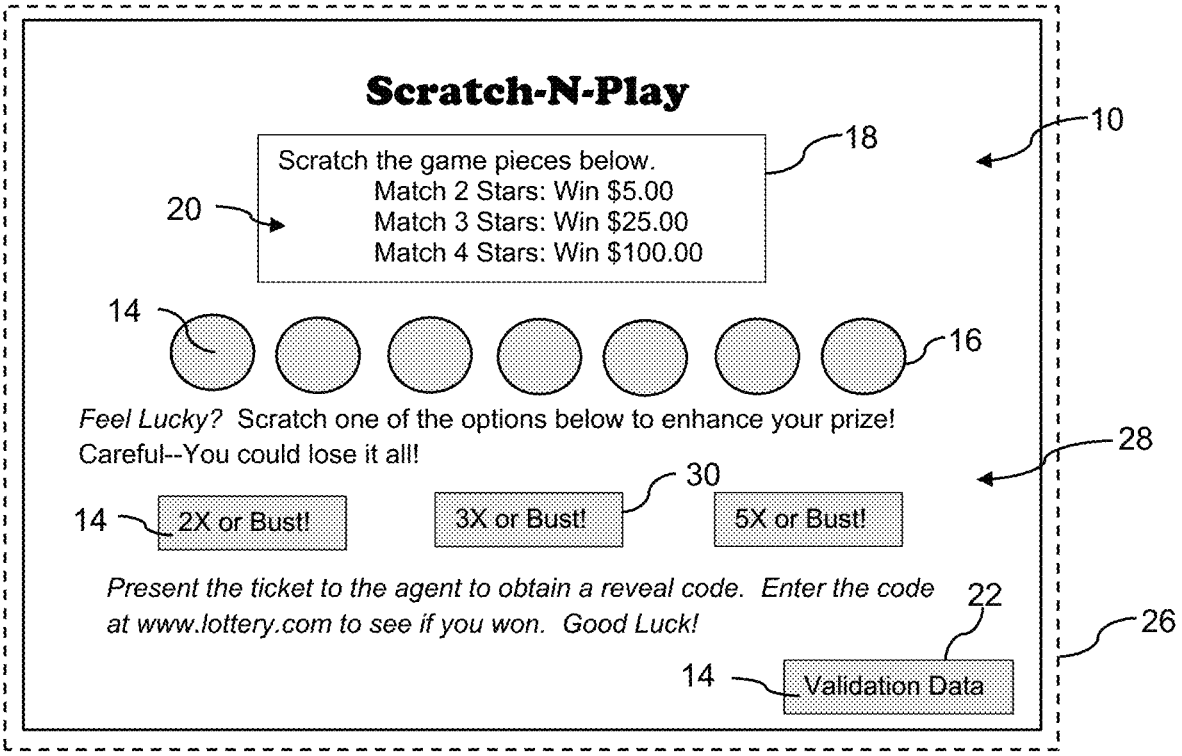
FIG. 1*a* depicts an instant scratch-off lottery ticket that may be used with the game structure and methods according to an exemplary embodiment of the present invention.
Figure 1B:
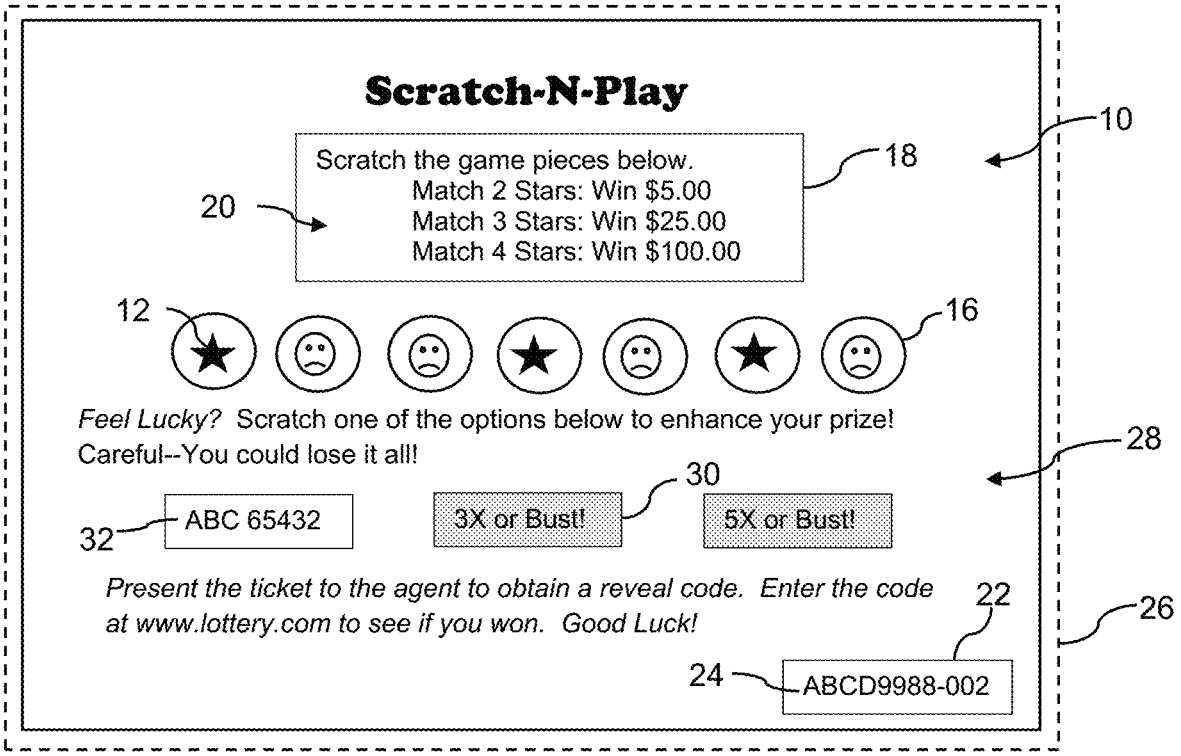
FIG. 1*b* depicts the instant scratch-off lottery ticket of FIG. 1*a* after being played.
Figure 1C:
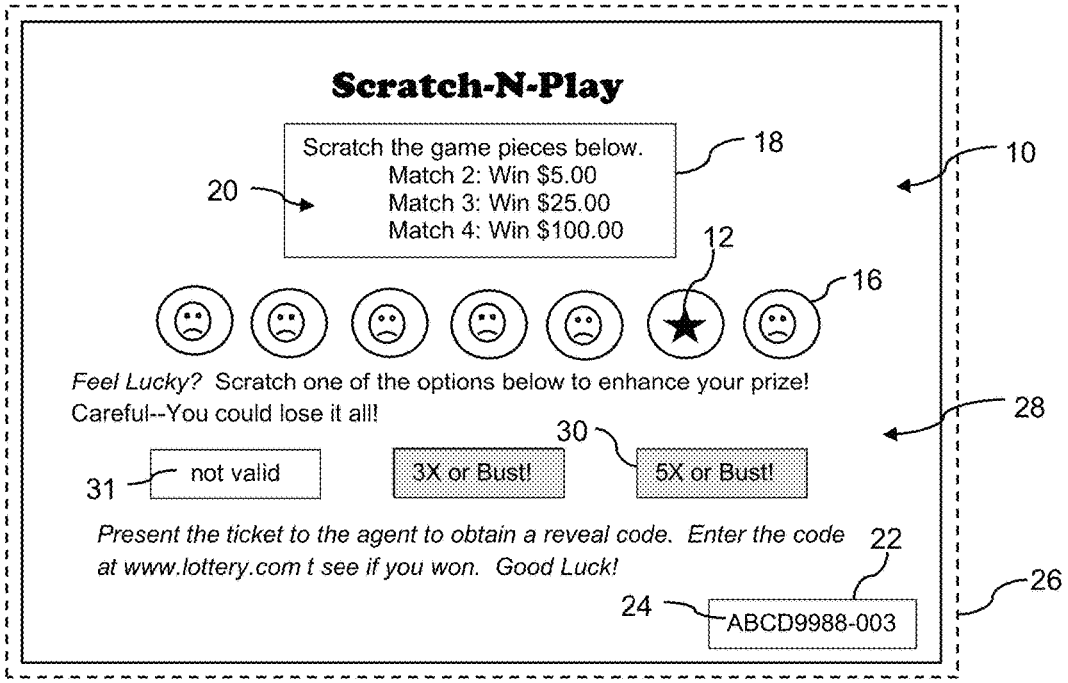
FIG. 1*c* depicts an instant scratch-off lottery ticket that is revealed to be a non-winner in the initial play of the ticket.

Referring to FIGS. 1*a*-1*c*, aspects of the instant lottery ticket game structure and method include a set or production run of instant lottery tickets 10 (i.e., scratch-off lottery tickets). As is well understood and mentioned above, a game set of such tickets 10 has a prize structure and odds distribution to achieve an "expected value" for the lottery authority. In this regard, a plurality of the instant lottery tickets 10 in the set are winning tickets that have a positive (greater than zero) predetermined first prize value. For example, the ticket 10 in FIG. 1*a* has a potential first prize value of $5, $25, or $100, as indicated by the prize value indicia 20. As with conventional instant lottery tickets, game play indicia 12 that reveals the win/loss outcome of the ticket 10 is provided at play spots 16 that are covered by a scratch-off coating 14. A player removes (i.e., scratches-off) the scratch-off coating 14 from the play spots 16 to reveal the game play indicia 12 and the status of the ticket, as well as the first prize value (if any).

The instant lottery tickets 10 may be printed paper stock tickets, or may be electronically simulated tickets that are transmitted to and played by the player via an application running on a smart device 50 (FIG. 4), such as a mobile phone, tablet, computer, etc., wherein a simulated scratch-off coating 14 covers the game play indicia 12. The dashed outline of the tickets 10 in FIGS. 1*a*-1*c* depict a screen 26 or other display of the player's smart device that is connected to a central host computer 42 (FIG. 4) to obtain/download the electronic ticket. The simulated scratch-off coating 14 can be removed by the player by operation of a mouse or some other control device connected or operable with the smart device 50.

Each lottery ticket 10 also includes validation data in the form of a validation code 24, which may be in the form of a barcode or alpha-numeric form, at a validation spot 22 on the ticket and covered by a scratch-off coating 14. As known in the industry, the validation code 24 contains ticket identification data that links the ticket to a record in a validation file stored in a host computer (discussed in greater detail below).

Evenly dispersed throughout the set of game tickets 10 will be the winning tickets (predetermined tickets that have one of the first prize values assigned thereto) that also have a predetermined enhanced second prize value assigned thereto that is greater than the first prize value. For example, the enhanced prize value may be a multiplier (e.g., 2× or 3×) of the first prize value. The number and prize distribution of these tickets is also computed so that, even if all of such enhanced prizes are distributed, the game still achieves its expected value. It is the hope of winning this enhanced prize that tempts the player trade the first prize value of the winning ticket for the second prize value. However, it is also possible that the second prize value is less than the first prize value, and may even be zero. Thus, the enhanced prize function of the game may also have an "all-or-nothing" aspect.

At least the winning tickets 10 in the set of game tickets are specifically modified to have a prize enhancement code 32 provided thereon, referring to FIGS. 1*a* and 1*b*. This code 32 may be alpha-numeric or contained in a bar code format. The prize enhancement code 32 can be unique to each ticket 10. Alternatively, the prize enhancement code 32 may be generic to all of the winning tickets, for example, akin to a "yes" or "positive" symbol on each ticket 10 that simply reflects the player's decision to opt for the enhanced prize, as explained in greater detail below. Whether unique to the ticket or generic, the prize enhancement code 32 is a device that provides an option to the player to opt for the second prize value that is assigned to their particular winning ticket 10 in the hopes of substantially increasing their winnings. This option has the risk, however, of reducing the first prize value, which includes a complete loss of the first prize value. For example, the player may opt for the enhanced second prize value in the hopes of doubling the first prize value, but the enhanced prize value assigned to the ticket 10 could actually be a reduction or loss of the first prize value, and the player would lose all or some of the first prize value as the "cost" for playing the option.

In the ticket 10 of FIGS. 1*a* and 1*b*, there are three enhanced prize options presented to the player in the event that the ticket 10 wins one of the first prize values. The multiple enhanced prize options are presented at game enhancement spots 30, wherein each spot 30 includes a game enhancement code 32 covered by a scratch-off coating 14. One of the spots 30 allows for the player to opt for a 2× multiplier of the first prize value at the risk of going "bust" (losing the first prize value). Other spots 30 allow for the player to opt for 3× and 5× multipliers (also with the chance of going bust), respectively. Obviously, the odds of winning a higher multiplier are less than winning a lower multiplier.

FIGS. 1*a* and 1*b* reflect that the ticket 10 is a winner of the first prize value in the amount of $25 (three matching stars), and that the player has opted for the 2× enhanced prize value by removing the scratch-off coating 14 from the "2×" spot 30 to reveal the underlying prize enhancement code 32. As explained below with reference to FIG. 4, this code 32 is transmitted to a central host computer 42 (or second computer 43) in accordance with aspects of the present structure and method.

It is industry practice for the ticket vendor to supply a validation file for each game, which is generally structured to contain a record for at least each winning ticket in the game set. This record contains the prize code or predetermined redemption value for each winning ticket in the game. In conventional game structures, the prize value represented by the prize code in each record provided by the vendor is fixed or static. For some games, the validation file will contain a respective record for only the winning tickets in the game set. However, in other embodiments, the validation file can contain a record for each ticket in the game. This vendor-supplied validation file is then loaded into a central host computer used by the entity that services the game for the lottery authority using appropriate data input means. All of these aspects may apply to the game structure and method of the present invention as well.

Figure 4:
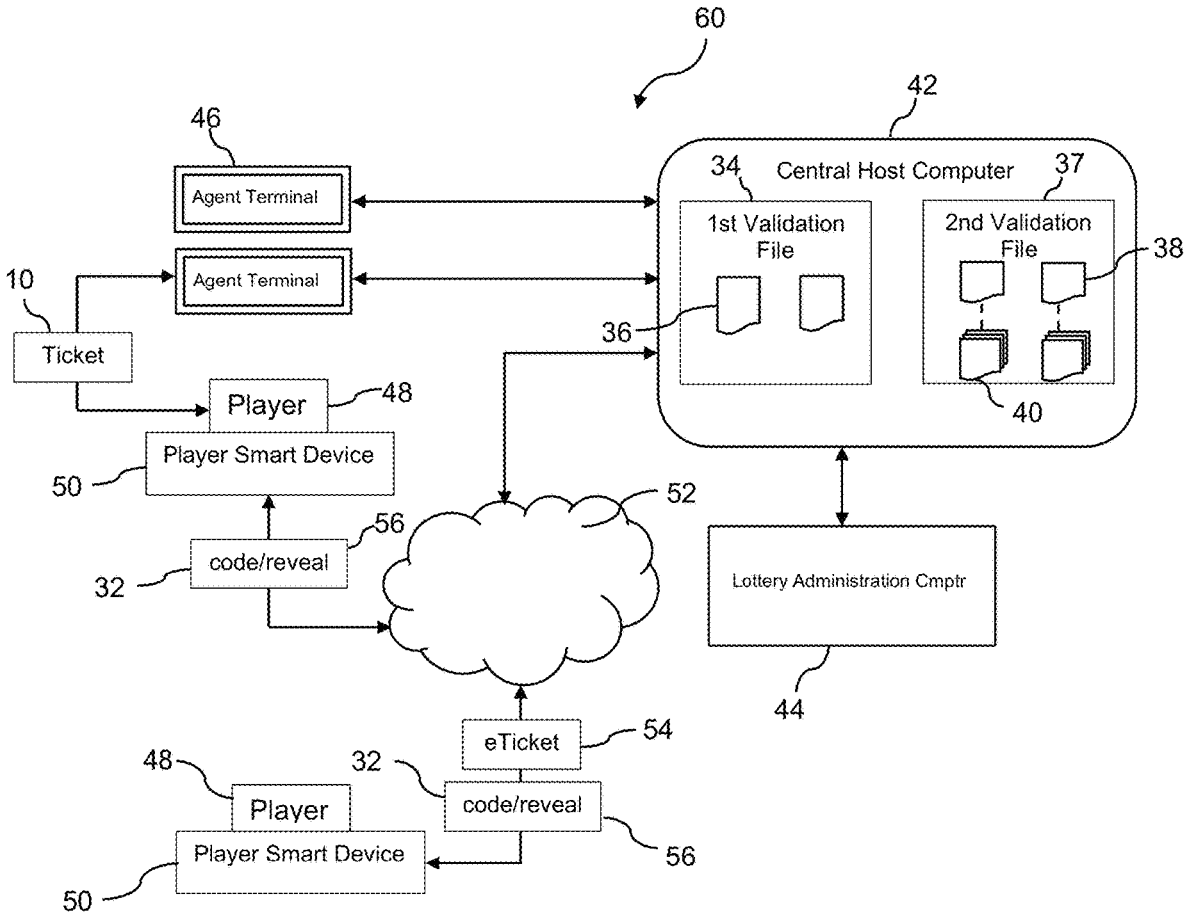
FIG. 4 is a block diagram of a lottery ticket game structure and associated method.

In many state lotteries in the U.S., the practice is to require that at least the high tier lottery tickets 10 presented by a player to a lottery agent for redemption be validated by having the lottery agent transmit ticket the validation code 24 from an agent terminal 46 to the host computer 42 (FIG. 4). This information is then used to access the record in the validation file that contains the prize code or redemption value for the lottery ticket 10, and this value is then transmitted back to the agent terminal 46. The usual practice is to have the lottery agent compare this value from the host computer 42 with the winning first prize value printed on the lottery ticket 10 and if they are the same, the agent will pay the player this amount or provide the player with a form that he can use to redeem the ticket from the lottery administration.

For purposes of the present game structure and method, the prize enhancement code(s) 32 may also be contained in the validation file record for each winning ticket 10.

Figure 2:
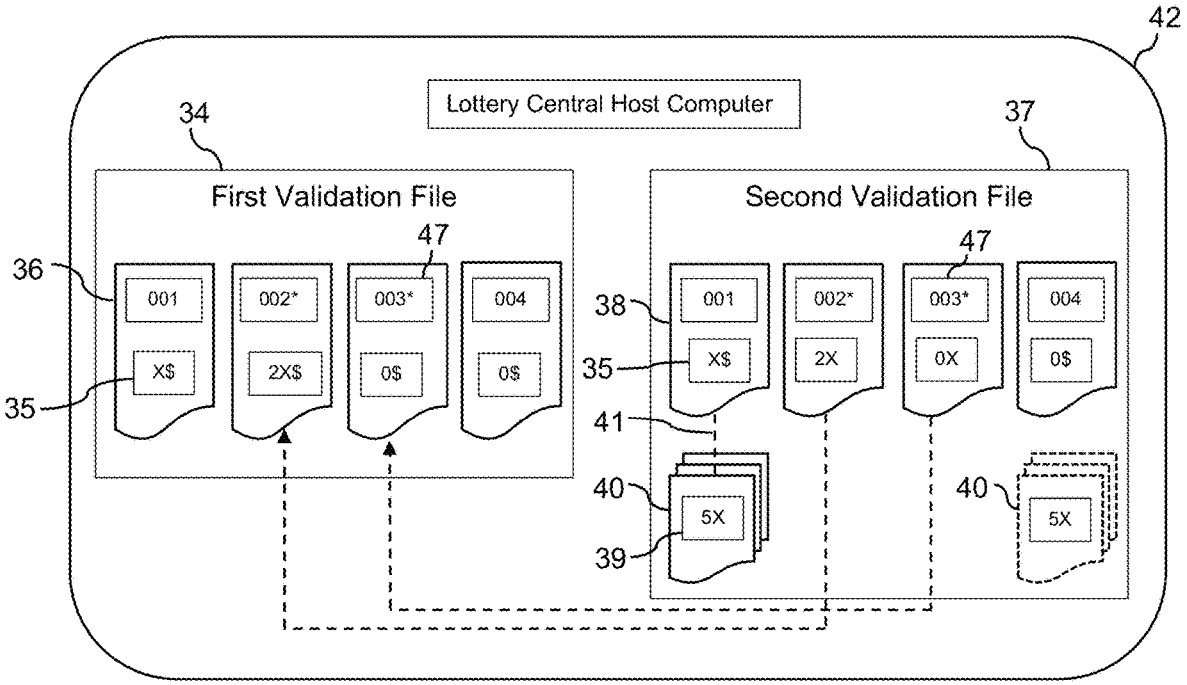
FIG. 2 is a block diagram of a first and second validation file configuration in accordance with aspects of the present invention.
Figure 3:
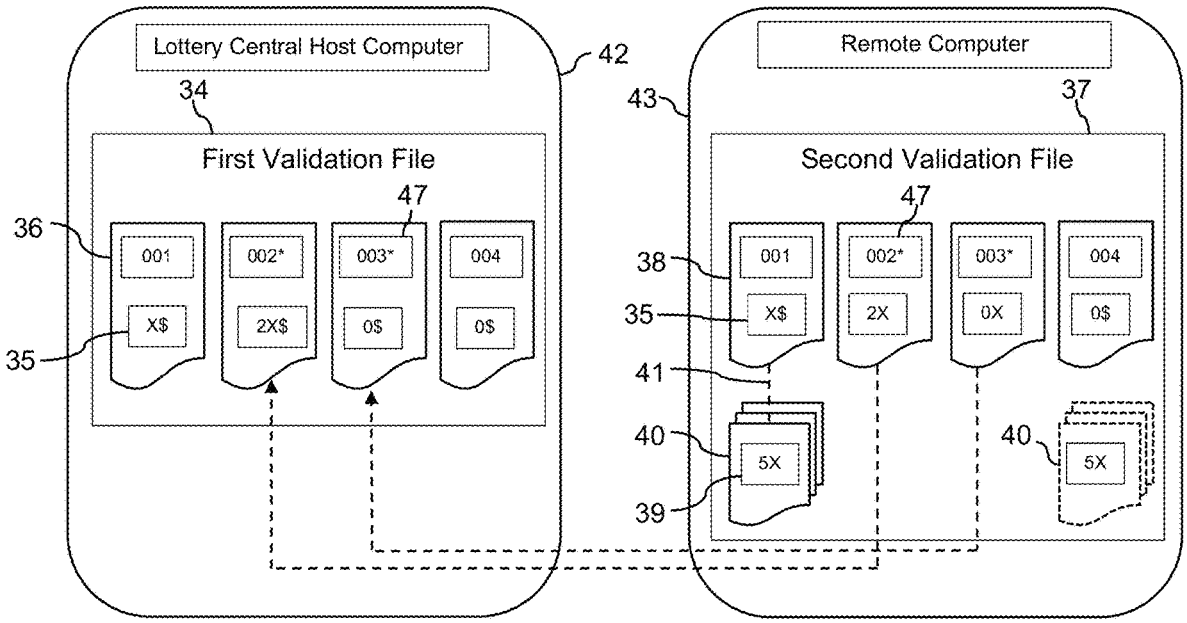
FIG. 3 is a block diagram of an alternate configuration of a first and second validation file configuration in accordance with aspects of the present invention.

In accordance with aspects of the present method and game structure, a unique validation file configuration is depicted in FIGS. 2 and 3. A first electronic validation file 34 is created and maintained in the central host computer 42 and includes a primary record 36 for at least each of the winning tickets 10 in the game set, and may include a primary record 36 for every ticket 10 in the game set, including the losing tickets 10. This primary record 36 includes ticket identification data and the predetermined first prize value 35 assigned to the winning ticket. For example, referring to FIG. 2, ticket 001 has a first prize value of "X$", whereas ticket 004 is a losing ticket (has an assigned first prize value of "0$". As mentioned above, if the player does not opt for the enhanced prize possibility, then the primary record 36 in the first validation file 34 will not be modified and remains as the final validation file record for that particular ticket.

A second validation file 37 is created and maintained by a computer, in this case the central host computer 42. This second validation file 37 is a "ghost" file and includes a base record 38 for at least each of the winning tickets 10 that essentially corresponds to the primary record 36 in the first validation file for the winning ticket 10, as well as the prize enhancement code 32 for the winning ticket 10. The second validation file 37 may include a base record 38 for each losing ticket 10 in the game set as well. The second validation file 37 also includes the second prize value 39 assigned to the winning ticket 10 either within the base record 38, or separate from the base record 38.

For example, as indicated in FIG. 2, for at least the winning tickets 10 in the game set, a sub-record 40 may be created at the same time as the base records 38 in the second validation file 37 and the primary records 36 in the first validation file 34. The sub-records 40 are, however, maintained separate from the base records 38 in the second validation file 37 to the extent that the information in the sub-record 40 that relates to the second prize value assigned to the ticket is not made part of the base record 38 unless a series of events occurs, as described below. The sub-record 38 includes the prize information linked to the prize enhancement code 32 and the second prize value assigned to the winning ticket 10 (if any). The sub-record 38 may also include a reduced first prize value if the game is structured so that the player does not lose the entire first prize value in the event there is no enhanced second prize value assigned to the ticket.

Referring to FIG. 2, it is depicted that the ticket 10 identified with the validation data "001" in its respective primary record 36 in the first validation file 34 has a first prize value 35 of X$. This same ticket identified in the base record 38 in the second validation file 37 has three sub-records 40 associated therewith (corresponding to one sub-record 40 for each of the 2×, 3×, and 5× prize enhancement options). The respective sub-record 40 corresponding to the player's selection may include a second (final) prize value 39 that is greater than the first prize value 35 (e.g., by a multiplier factor of 2× or 3×), a second prize value 39 of zero, or a second prize value 39 that is less than the first prize value 35 (e.g. one-half of the first prize value). The sub-records 40 are associated with the base record 38 by a digital logic gate depicted by the dashed line 41. In FIG. 2, the particular ticket identified as 001 has not yet been played (or was played but the player did not opt for the enhanced prize possibility) and thus the second prize value has not been used yet to modify the base record 38.

Upon entry of the prize enhancement code 32 into the host computer 42 by or for the player (e.g. entered by the lottery agent scanning the validation code 24 and the prize enhancement code 32 from the winning ticket 10), the digital logic gate 41 in the base record 38 is activated wherein the computer 42 automatically modifies the base record 38 to include/substitute the second prize value 39 as the actual prize for the winning ticket. This may be accomplished by various means. For example, the second prize value 39 may be contained in the base record 38 along with the first prize value 35, wherein the first prize value 35 is essentially deleted from the base record 38 upon entry of the prize enhancement code. Alternatively, as discussed above with respect to FIG. 2, the second prize value 39 may be contained in the separate sub record 40 and imported into the base record 38 to overwrite the first prize value 35 upon entry of the prize enhancement code.

For example, as discussed, the winning ticket 10 in FIG. 1*b* includes three prize enhancement options (and thus three separate prize enhancement codes 32). For purposes of illustration, this ticket 10 is identified in the validation code 24 by the last three digits "002". The ticket has a first prize value of $25 and the player has opted for the 2× prize enhancement by removing the scratch-off coating 14 from the 2× spot 30 to reveal the prize enhancement code 32 (which is scanned and transmitted to the central host computer 42). In FIG. 2, the digital logic gate 41 in the base record 38 for this ticket (in the second validation file 37) has been activated and links the 2× sub-record 40 to the base record 38 for this ticket. The enhanced prized value information contained in the sub-record 40 is used to modify the base record 38 to create a final record 47. In FIG. 2, the record 38 indicated as "002*" is a final record 47 wherein its respective base record 38 has been modified to include the second prize value 39 (2×$) as a final prize value for the ticket 10. The ticket record 003* is a final record 47 that was modified to include the second prize value of "0×$", meaning that the second prize was actually a loss of the entire first prize value.

The central host computer 42 is configured to periodically and securely update the first validation file 34 with the final records 47 generated in the second validation file 37, as indicated by the dashed lines in FIG. 2. It should be appreciated that "periodic" includes every time a final record 47 is generated in the second validation file 37, or at scheduled times, such as every day at midnight.

FIG. 2 depicts the central host computer 42 as the computer that maintains the first validation file 34 and the second validation file 37. This may be the scenario wherein the same party or entity initially generates the validation files 34, 37 (e.g., the lottery ticket provider) and administers the lottery for the state or governmental agency.

FIG. 3 depicts an embodiment wherein the second validation file 37 is maintained by a computer 43 that is separate and remote from the central host computer 42. In this scenario, one party or entity that initially generates the validation files 34, 37 (e.g., the lottery ticket provider) may not be the party that administers the lottery for the state. The initial secure validation file 34 can be delivery or transmitted to such third-party via secure means, wherein the third party maintains the computer 43 and administers the state lottery game. The computer 43 and central computer 42 are configured in secure communication so that the final records 47 generated in the second validation file 37 are periodically transmitted to the first validation file 34, as discussed above. In this embodiment, the prize enhancement codes 32 would be transmitted to the computer 43 directly from the agent terminals 46 or via the central host computer 432 to activate the logic gates 41 in the based records 38 of the second validation file 37.

Referring to FIG. 1*c*, in a certain embodiment, losing lottery tickets 10 in the set may also include one or more simulated prize enhancement codes in the form of a scratch-off coating 14 over a generic indication 31 that the ticket is a losing ticket in the defined prize enhancement section 28 of the ticket so that winning and losing tickets 10 are indistinguishable to the player prior to purchase and play of the ticket 10. FIG. 2 represents that a base record 38 is created in the second validation file 37 for each losing ticket as well, but there are no sub-records 38 associated with the losing tickets 10. In an alternative embodiment, sub-records 38 may also be created for each losing ticket 10 for sake of sameness in the file structure, but are inactive. For example, the digital logic gate function may not be provided in the base records 36, which would prevent lining of a sub-record 40 (as indicated by the dashed lines of sub-records 40 for ticket 004).

With the above game structure and method 60, the first validation file 34 is "dynamic" is that it the individual ticket primary records 36 contained therein are automatically changed or updated to reflect the changing prize value of any of the instant lottery tickets 10 in the set. For redemption, accounting, confirmation, and any other post-sale reason, the validation file 34 accurately reflects the final value of the tickets 10 in the set. This is accomplished without the need of personnel intervention or access to the validation file.

Referring to FIG. 4, the game structure and method 60 may include a unique means of revealing the outcome of the enhanced prize option to the player 48. For example, the game structure 60 may include a computer application enabled on a smart device 50 operated by the player 48 (e.g. a smart phone, tablet, PDA, computer, etc.), wherein results of entry of the prize enhancement code are revealed to the player via the smart device 50 upon entry of a reveal code or other message by the player 48 to the central host computer 42 via any suitable communications network 52. This code may be provided on the winning ticket 10, for example along with the prize enhancement code 32 under the scratch-off coating, or may be the actual prize enhancement code 32 (particularly if there are multiple possible enhanced prize opportunities presented on a single ticket, as in the embodiment depicted in the figures). Alternatively, the code may be generated and given to the player when the prize enhancement code 32 is entered by the lottery agent at a terminal 46. For example, the terminal 46 may print off a receipt having the reveal code thereon, wherein the receipt is then handed to the player 48. Once the code request is received by the host computer 42, a reveal message 56 is generated and transmitted back to the player's smart device 50. This reveal message will indicate the final prize value for the player's winning ticket after exercise of the enhanced prize option by the player, as well as instructions as to how the player can redeem the prize.

FIG. 4 also depicts the electronic ticket 54 version of the structure and method 60 wherein the electronic simulated scratch-off ticket 54 is transmitted to the player's smart device 50 for play. If the ticket 54 is a winning ticket, the player 48 can then opt for one of the enhanced prize options on the ticket 54 by transmitting the request code (which may be the actual game enhancement code 32). The reveal message 56 will then be generated and transmitted back to the player's smart device 50.

It should be appreciated that the central host computer 42 and computer 43 (e.g., a game server) can include a network interface for providing communications over the network 52. A network interface can include any suitable components for interfacing with one more networks, including for example, transmitters, receivers, ports, controllers, antennas, or other suitable components.

The computers 42, 43 can be any computing device and can include one or more processors and one or more computer-readable media. The computer-readable media can store instructions which cause the processor to perform the operations described herein, as well as other functions related to conduct of the overall game for the lottery authority.

The player's smart device 50 can be any portable computing device that can be used by a player to interface with the host computer 42 or other computer 43. For instance, the device 50 can be a wireless device, a personal digital assistant (PDA), portable gaming device, cellular phone, smart phone, tablet, navigation system, handheld GPS system, wearable computing device, a display having one or more processors, or other such device. In short, the player device 50 can be any computer-device or system that can execute a gaming module to allow a player to interact with the host computer 42 or other computer 43 as described herein.

The network 52 can be any type of communications network, such as a local area network (e.g. intranet), wide area network (e.g. Internet), or some combination thereof. The network can also include a direct connection between a player mobile device 50 and the host computer 42 or other computer 43. In general, communication between the host computer 42, other computer 43, and player mobile device 50 can be carried via a network interface using any type of wired and/or wireless connection, using a variety of communication protocols (e.g. TCP/IP, HTTP, SMTP, FTP), encodings or formats (e.g. HTML, XML, JSON), and/or protection schemes (e.g. VPN, secure HTTP, SSL).

FIG. 4 also depicts a lottery authority administrative computer 44 interfaced with the central host computer 42 for any manner of functions, including receipt of reports generated by the game service provider based on the modifications and changes made to the base records in the dynamic validation file 34 as described herein.

The technology discussed herein makes reference to servers, computers, databases, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, server processes discussed herein may be implemented using a single server or multiple servers working in combination. Databases and applications may be implemented on a single system or distributed across multiple systems. Distributed components may operate sequentially or in parallel.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An instant lottery ticket game structure system, comprising:

a set of instant lottery tickets, the lottery tickets comprising printed paper tickets or electronically simulated tickets displayed on a player's smart device, wherein a plurality of the instant lottery tickets are winning tickets that have a positive predetermined first prize value that is revealed to a player by removal of a scratch-off coating on the printed tickets or simulated on the electronically simulated tickets from over prize indicia provided printed or displayed on the winning tickets;

at least the winning tickets having a prize enhancement code printed or electronically displayed thereon that enables the player with the option to trade the first prize value for a potential enhanced prize having a value that is greater than the first prize value, wherein each winning ticket has a predetermined second prize value assigned thereto corresponding to the enhanced prize that may be greater than or less than the first prize value;

a first electronic validation file maintained in a central host computer, the first validation file including a primary record for at least each of the winning tickets, the primary record including ticket identification data and the predetermined first prize value for the winning ticket;

a second electronic validation file maintained by a computer, the second validation file including a base record for at least each of the winning tickets that corresponds to the primary record in the first validation file for the winning ticket and includes the prize enhancement code for the winning ticket, the second validation file further comprising the second prize value assigned to the winning ticket;

a computer logic gate in the base record that automatically activates upon entry of the prize enhancement code, wherein the computer then creates an electronic final record for the winning ticket by modifying the base record to include the second prize value as a final prize value for the winning ticket; and the central host computer configured to periodically update the first validation file with the final records generated in the second validation file.

2. The instant lottery ticket game structure system of claim 1, wherein the computer that maintains the second validation file is the central host computer.

3. The instant lottery ticket game structure system of claim 1, wherein the computer that maintains the second validation file is separate and remote from the central host computer, the final records generated by the second validation file periodically transmitted to the central host computer.

4. The instant lottery ticket game structure system of claim 1, wherein the prize enhancement code is covered by a scratch-off coating on the printed tickets or simulated on the electronically simulated instant lottery tickets, wherein the player removes the scratch-off coating and the prize enhancement code is transmitted to the central host computer.

5. The instant lottery ticket game structure system of claim 1, wherein the first validation file includes a primary record for each of the instant lottery tickets in the set of instant lottery tickets, and the second validation file includes a base record for each of the instant lottery tickets in the set of instant lottery tickets.

6. The instant lottery ticket game structure system of claim 5, wherein each of the instant lottery tickets in the set of instant lottery tickets includes prize enhancement code provided thereon, and wherein the prize enhancement code is only active for the winning tickets.

7. The instant lottery ticket game structure system of claim 1, wherein the enhanced prize has a potential value that is (a) a multiple of the first prize value; (b) less than the first prize value; or (c) a total loss of the first prize value.

8. The instant lottery ticket game structure system of claim 1, further comprising a computer application enabled on a smart device operated by the player, wherein results of entry of the prize enhancement code are revealed to the player via the smart device upon entry of a reveal code by the player.

9. The instant lottery ticket game structure system of claim 6, wherein the reveal code entered by the player is provided on the winning ticket.

10. The instant lottery ticket game structure system of claim 6, wherein the reveal code entered by the player is generated and given to the player when the prize enhancement code is entered.

11. A method for implementing an instant lottery ticket game with a central host computer linked to instant lottery tickets by codes printed or electronically displayed on the instant lottery tickets, comprising:

providing a set of the instant lottery tickets as printed paper tickets or electronically simulated tickets on a player's smart device, including designating a plurality of the instant lottery tickets as winning tickets that have a positive predetermined first prize value assigned thereto that is revealed to a player by removal of a scratch-off coating on the paper tickets or simulated on the electronically simulated tickets from over prize indicia provided on the winning tickets;

providing at least the winning tickets with a printed or electronically displayed prize enhancement code that provides the player with the option to trade the first prize value for an enhanced prize having a potential value that is greater than the first prize value;

assigning a predetermined second prize value to the winning tickets that may be greater than or less than the first prize value, the second prize value corresponding to the enhanced prize;

prior to distribution of the instant lottery tickets for sale, creating a first electronic validation file and maintaining the first validation file in a central host computer, the first validation file including a primary record for at least each of the winning tickets, the primary record including ticket identification data and the predetermined first prize value for the winning ticket;

at the time of creating the first validation file, creating and maintaining a second electronic validation file in a computer, the second validation file including a base record for at least each of the winning tickets, the base record including the ticket identification data from the primary record in the first validation file for the winning ticket and the prize enhancement code for the winning ticket, the second validation file further comprising the second prize value assigned to the winning ticket;

configuring the base record with a computer logic gate that automatically activates upon entry of the prize enhancement code, wherein the computer then creates a final record for the winning ticket by modifying the base record to include the second prize value as a final prize value for the winning ticket; and with the central host computer, periodically updating the first validation file with the final records generated in the second validation file.

12. The method of claim 11, wherein the computer that maintains the second validation file is the central host computer.

13. The method of claim 11, wherein the computer that maintains the second validation file is separate and remote from the central host computer, the final records generated by the second validation file periodically transmitted to the central host computer.

14. The method of claim 11, wherein the prize enhancement code is covered by a scratch-off coating printed or electronically simulated on the instant lottery tickets, wherein the player removes the scratch-off coating and the prize enhancement code is transmitted to the central host computer.

15. The method of claim 11, wherein the first validation file includes a primary record for each of the instant lottery tickets in the set of instant lottery tickets, and the second validation file includes a base record for each of the instant lottery tickets in the set of instant lottery tickets, and wherein each of the instant lottery tickets in the set of instant lottery tickets includes a prize enhancement code provided thereon, and wherein the prize enhancement code is only active for the winning tickets.

16. The method of claim 11, further comprising providing a computer application that is enabled on a smart device operated by the player, wherein results of entry of the prize enhancement code are revealed to the player via the smart device upon entry of a reveal code by the player, wherein the reveal code is provided on the winning ticket or is generated and given to the player when the prize enhancement code is entered.

* * * * *